US006595330B1

(12) United States Patent
Henrickson et al.

(10) Patent No.: US 6,595,330 B1
(45) Date of Patent: Jul. 22, 2003

(54) WORK PLATFORM CONTROL SYSTEM FOR A BOOM-TYPE VEHICLE

(75) Inventors: Lance B. Henrickson, Slinger, WI (US); Merrick O. Monaghan, Yankton, SD (US); Anthony J. Saiia, Mequon, WI (US)

(73) Assignee: Gehl Company, West Bend, WI (US)

( * ) Notice: Subject to any disclaimer, the term of this patent is extended or adjusted under 35 U.S.C. 154(b) by 0 days.

(21) Appl. No.: 10/058,364

(22) Filed: Jan. 28, 2002

Related U.S. Application Data

(60) Provisional application No. 60/265,474, filed on Jan. 31, 2001.

(51) Int. Cl.[7] ..... B66B 1/12; B66F 9/06

(52) U.S. Cl. ..... 187/277; 187/223; 187/224

(58) Field of Search ..... 187/276, 277, 187/222, 223, 224, 231, 233; 182/2.1, 12, 13, 14, 19, 64.1, 66.2, 69.4, 69.6, 115; 414/10, 427, 598, 600, 744.1

(56) References Cited

U.S. PATENT DOCUMENTS

| | | | | |
|---|---|---|---|---|
| 2,820,561 A | | 1/1958 | Meagher | 214/620 |
| 2,966,956 A | | 1/1961 | Campbell et al. | 182/63 |
| 3,204,720 A | | 9/1965 | Eitel | 182/19 |
| 3,285,365 A | | 11/1966 | Longton | 182/63 |
| 3,352,441 A | | 11/1967 | Alden | 214/130 |
| 3,379,281 A | | 4/1968 | Calletti et al. | 182/113 |
| 3,380,554 A | | 4/1968 | Duryee | 182/46 |
| 4,162,873 A | | 7/1979 | Smith, Jr. | 414/718 |
| 4,331,215 A | * | 5/1982 | Grove et al. | 182/2.1 |
| 4,537,281 A | | 8/1985 | Endres et al. | 182/2 |
| 4,687,406 A | | 8/1987 | Kinsey | 414/701 |
| 4,744,718 A | | 5/1988 | Logan et al. | 414/724 |
| 5,021,917 A | * | 6/1991 | Pike et al. | 361/195 |
| 5,088,020 A | * | 2/1992 | Nishida et al. | 700/40 |
| 5,551,527 A | | 9/1996 | Luscombe | 182/2 |
| 5,555,953 A | | 9/1996 | Henderson | 182/141 |
| 5,740,887 A | * | 4/1998 | Unger et al. | 187/231 |
| 6,272,413 B1 | * | 8/2001 | Takahashi et al. | 701/50 |
| 6,378,653 B1 | * | 4/2002 | Takahashi | 182/69.4 |

* cited by examiner

*Primary Examiner*—Jonathan Salata
(74) *Attorney, Agent, or Firm*—Andrus, Sceales, Starke & Sawall, LLP

(57) ABSTRACT

A vehicle, such as an extendible boom forklift, that includes a personnel work platform (PWP). The personnel work platform includes a shut-off switch that is connected to the electronic controls for the extendible boom forklift. The operational controls of the extendible boom forklift include a personnel work platform control system that modifies the operation of the extendible boom forklift when the forklift is in a PWP mode. The PWP control system receives inputs from the shut-off switch, a PWP system actuation switch, a service brake pressure switch and a level sensor/switch such that the control system enables the PWP mode only upon satisfying certain safety-related concerns. In the PWP mode, the control system engages the parking brake, declutches the transmission, locks the frame stabilizing cylinder, deactivates the auxiliary and tilt hydraulic functions and limits the frame leveling rate to slow speeds.

24 Claims, 4 Drawing Sheets

WORK PLATFORM CONTROL SYSTEM FOR A BOOM-TYPE VEHICLE

CROSS REFERENCE TO RELATED APPLICATION

The present application is based on and claims priority to U.S. Provisional Patent Application Serial No. 60/265,474 filed on Jan. 31, 2001.

BACKGROUND OF THE INVENTION

The present invention generally relates to a boom-type vehicle, such as an extendible boom forklift, as is commonly used in construction, industrial, maintenance and repair applications. More particularly, the present invention relates to a control system for such reach-type vehicle that is adapted for use in combination with a personnel work platform (PWP) that can be used in combination with the reach-type vehicle.

Presently, extendible boom forklifts can be used with a separate personnel work platform such that the forklift can be used to raise and lower workers standing on the platform based on various workplace requirements. The personnel work platform typically includes a pair of tubular fork receivers that receive the forks of the forklift such that the personnel work platform is supported on the forks of the forklift. Typically, an operator sits in the cab of the extendible boom forklift and raises and lowers the personnel work platform into the desired location. Thus, the combination of the personnel work platform and the extendible boom forklift increase the number of functions the extendible boom forklift can perform at a workplace.

Although the combination of the extendible boom forklift and the personnel work platform increase the utility of the extendible boom forklift, the workers supported by the personnel work platform can be injured if the control functions of the extendible boom forklift are not modified when the personnel work platform is being used. For example, if workers are on the platform and the forklift is allowed to move or the fork assembly is allowed to rotate, or the forklift frame is not leveled correctly, the workers could become injured as a result of such movement.

Therefore, it is an object of the present invention to provide a control system for an extendible boom forklift or similar boom-type vehicle that limits the operation of the vehicle when the personnel work platform is being used. Further, it is an object of the present invention to provide relatively slow movement of the frame leveling cylinder when the personnel work platform is in use. A still further object of the invention is to provide a system for preventing movement of the vehicle and for providing controlled movement of the boom when the personnel work platform is in use. Further, it is an object of the present invention to incorporate a shut-off switch on the personnel work platform such that the workers standing on the personnel work platform can shut down operation of the vehicle boom from the work platform. Yet another object of the invention is to provide a PWP control system that locks the stabilizing cylinder of the forklift and prevents operation of auxiliary hydraulics when the forklift is in a PWP mode of operation.

SUMMARY OF THE INVENTION

The present invention is a control system that modifies the operation of a boom-type vehicle, such as an extendible boom forklift, when the vehicle is being used in connection with a personnel work platform (PWP). The PWP control system of the present invention modifies the operation of the forklift to increase the safety of workers positioned on the work platform.

The PWP control system includes a shut-off switch that is mounted near the work platform and a PWP system actuator switch. The shut-off switch and PWP system actuator switch are interconnected with a control microprocessor included in the electronic operating circuit for the forklift. The control microprocessor is configured to selectively operate various operating components of the forklift in a PWP mode, which is different than the normal mode of operation.

The PWP system actuator switch is positioned in the cab of the forklift and must be actuated for the PWP control system to enter the PWP mode. In addition to the actuation of the PWP system actuator switch, the microprocessor must detect the simultaneous actuation of the service brakes. Specifically, the PWP system actuator switch and the service brakes must be simultaneously applied for a period of five seconds before the microprocessor allows the control system to enter the PWP mode.

Upon entering the PWP mode, the PWP control system performs several functions to further ensure the safety of a worker on the personnel work platform. Upon entering the PWP mode, the microprocessor sends a signal to the transmission controller, which causes the transmission of the forklift to declutch, to prevent movement of the forklift. At the same time, the processor activates the parking brake and locks the rear axle stabilizing system of the forklift to provide a secure four-point stance.

Once the forklift enters the PWP mode, the PWP control system checks to determine whether the cab of the forklift is in a generally level orientation. Specifically, a level sensor/switch in the cab provides a signal to the microprocessor indicating the orientation of the cab. If the sensor/switch determines that the cab is tilted one way or the other more than 2°, the microprocessor will disable operation of the forklift boom to prevent movement of the personnel work platform.

In addition to controlling various operational components of the forklift, the microprocessor causes a restriction in the flow of hydraulic fluid to the leveling cylinder of the forklift upon entering the PWP mode. The flow restriction reduces the rate at which the leveling cylinder operates to prevent a worker on the platform from being thrown from the platform due to a tip-over of the forklift caused by incorrect movement of the leveling cylinder.

The PWP control system of the invention includes the shut-off switch that is mounted to the personnel work platform. If a worker on the personnel work platform desires to prevent any further movement of the boom, the worker can depress the shut-off switch. When the shut-off switch is moved to its OFF position, the microprocessor activates a joystick disengage solenoid that prevents any further movement of the boom. Thus, a worker on the platform can prevent further movement of the platform by an operator in the forklift cab.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
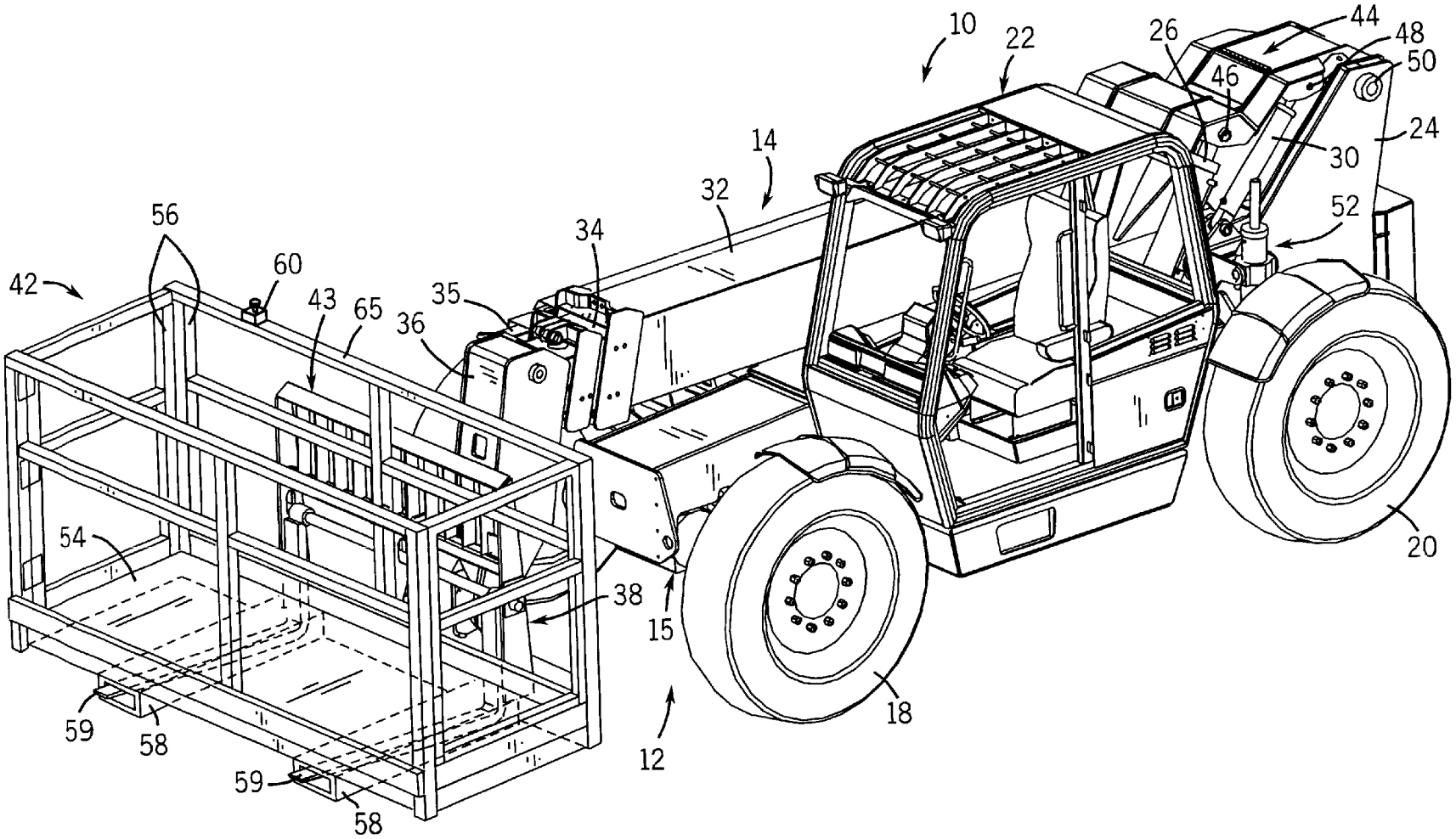
FIG. 1 is an isometric view of a boom-type vehicle, in the form of an extendible boom forklift, including a personnel work platform (PWP) incorporating the subject matter of the present invention.

Referring to FIG. 1, a vehicle in the form of an extendible boom forklift 10 generally includes a frame or chassis 12 and a boom assembly 14 mounted to chassis 12. Chassis 12 includes a central frame member 15 extending in a longitudinal front-rear direction. A pair of front ground-engaging wheels and tires 18 are carried by a front axle assembly mounted toward the forward end of central frame member 15, and a pair of rear ground-engaging wheels and tires 20 are mounted toward the rearward end of central frame member 15. A cab 22 is mounted between front wheels 18 and rear wheels 20 on one side of central frame member 15, and a drive train is mounted on the side of central frame member 15 opposite cab 22.

A pair of uprights 24 are mounted to central frame member 15 toward its rearward end, rearwardly of cab 22 and wheels 20. A pair of lift cylinders 26 are located one on either side of frame 15, and each lift cylinder 26 is connected to chassis 12 via a pivot connection which pivotably secures the cylinder end of the lift cylinder 26 to chassis 12 for movement about a substantially horizontal pivot axis. A pair of slave cylinders 30 are also located one on either side of chassis 12, and the cylinder end of each slave cylinder 30 is connected to chassis 12 via a pivot connection which provides pivoting movement of the slave cylinder 30 about a substantially horizontal pivot axis.

Boom assembly 14 generally includes an outer boom member 32 and an intermediate boom member 34 which is received within an internal passage defined by outer boom member 32 for telescoping inward and outward movement relative to outer boom member 32. Boom assembly 14 further includes an inner boom member 35 received within an internal passage defined by intermediate boom member 34 and is mounted for axial inward and outward telescoping movement relative to intermediate boom member 34. A nose section 36 is mounted to the forward end of the inner boom member 35, and is located forwardly of the forward end of chassis 12. A drive arrangement provides inward and outward movement of intermediate boom member 34 and the inner boom member 35 to which nose section 36 is mounted, in a manner as is known.

A tool mounting assembly 38 is pivotably mounted to the lower end of nose section 36, and a tilt cylinder (not shown) is interposed between nose section 36 and tool mounting assembly 38. Tool mounting assembly 38 includes an arrangement for releasably engaging a tool with boom assembly 14 through nose section 36. As shown in the drawings, personnel work platform (PWP) 42 is received by a fork assembly 43 mounted to the tool mounting assembly 38.

Boom assembly 14 includes a mounting structure 44 toward its rearward end. Lift cylinder 26 is engaged with mounting structure 44 via a pivot connection 46, and slave cylinder 30 is connected to mounting structure 44 via a pivot connection 48. A pivot shaft 50 is operable to pivotably mount boom assembly 14 to uprights 24 through mounting structure 44. Boom assembly 14 is pivotable about a pivot axis defined by the longitudinal axis of pivot shaft 50.

With the arrangement as described above, boom assembly 14 is operable to lift the personnel work platform 42. Extension of lift cylinders 26 functions to pivot boom assembly 14 upwardly about pivot shaft 50 to lift the personnel work platform 42 and likewise retraction of cylinders 26 functions to lower the personnel work platform 42 by allowing boom assembly 14 to pivot downwardly about pivot shaft 50.

In a manner as is known, the rear axle assembly, to which rear wheels 20 are mounted, is pivotable relative to central frame member 15 to provide oscillating movement of wheels 20 relative to chassis 12 as forklift 10 travels over uneven terrain. A stabilizing cylinder assembly 52 is interposed between central frame member 15 and the rear axle assembly, to cushion shocks which would otherwise be experienced by central frame member 15 and the components mounted thereto, such as cab 22 and boom assembly 14, during such oscillating movement of wheels 20 relative to central frame member 15. In FIG. 1, stabilizing cylinder 52 is shown as being located at the left side of forklift 10.

In a similar manner, the front axle assembly, to which front wheels 18 are mounted, is pivotable relative to central frame member 15 to provide oscillating movement of wheels 18 as forklift 10 travels over uneven terrain. A frame leveling cylinder (not shown in FIG. 1) is located at the right side of forklift 10 and is interconnected between central frame member 15 and the front axle assembly. In a manner as is known, the frame leveling cylinder is utilized to level chassis 12 relative to wheels 18 and 20 when forklift 10 is parked on uneven terrain and boom assembly 14 is to be raised and extended to place a load carried by fork assembly 43 onto an elevated surface. In accordance with a conventional operation, stabilizing cylinder 52 is automatically locked in position upon actuation of the frame leveling cylinder to fix the position of rear wheels 20 relative to central frame member 15, and operation of the leveling cylinder, located between the front axle assembly and central frame member 15, is operable to move chassis 12 to a level position.

Extendible boom forklift 10 and fork assembly 43 are of conventional construction. Representatively, extendible boom forklift 10 may be that such as is available from Gehl Company of West Bend, Wisconsin under its designation DYNALIFT®, and fork assembly 43 may be a fork attachment as is also available from Gehl Company of West Bend, Wisconsin and adapted for use in combination with its DYNALIFT series of extendible boom material handlers.

As shown in FIG. 1, the personnel work platform assembly 42 is adapted for use in combination with extendible boom forklift 10. In accordance with known construction, the personnel work platform 42 includes a floor 54 and a series of vertical railing sections 56. Personnel work platform 42 further includes a pair of tubular fork receivers 58 secured to the frame of personnel work platform 42 below floor 54. Each fork receiver 58 defines an internal passage adapted to receive one of the forks 59 of the fork attachment 43, such that personnel work platform 42 can be carried by the end of extendible boom 14 in order to elevate personnel for various tasks. Personnel work platform 42 is again of conventional construction, and may be that such as is available from Star Industries of Fort Worth, Tex.

Figure 2:
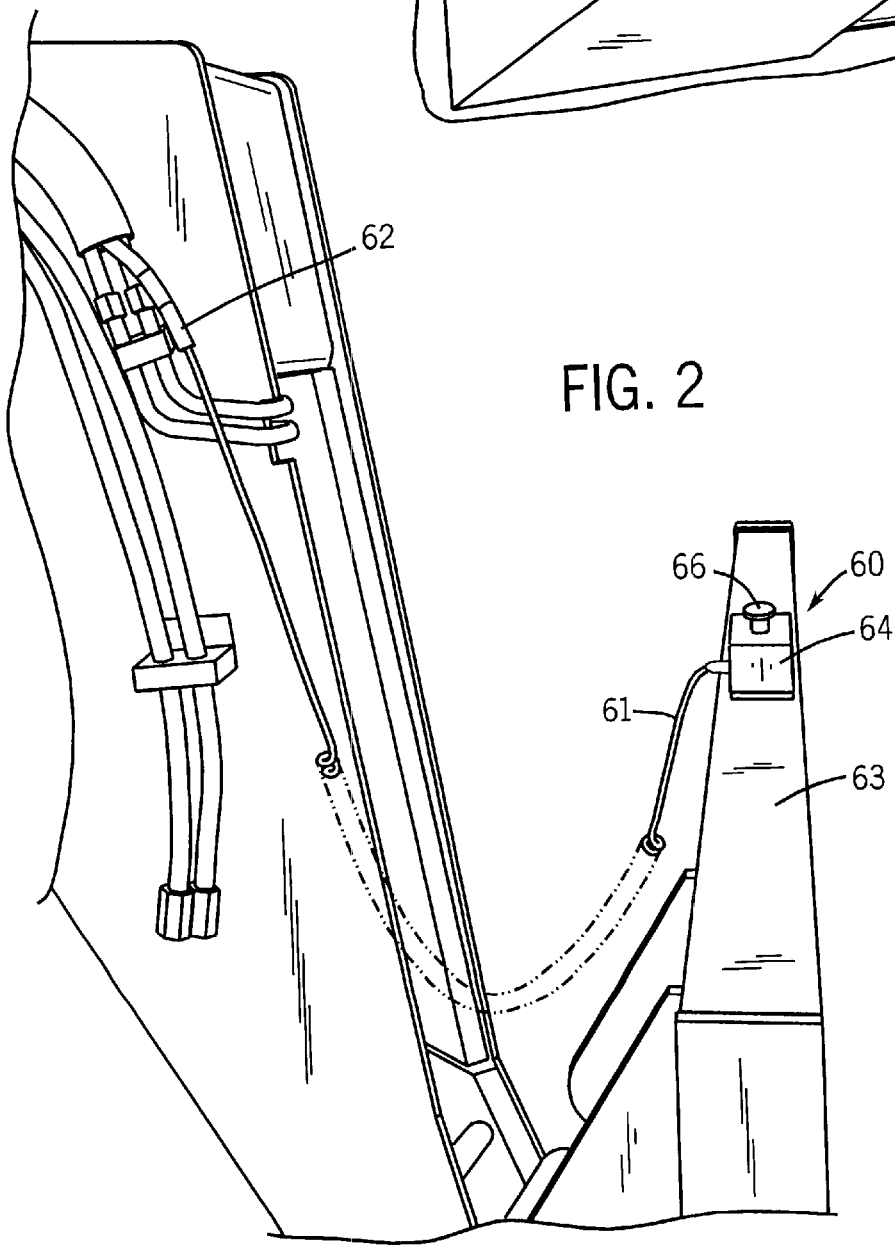
FIG. 2 is a partial perspective view of the shut-off switch mounted to the personnel work platform.

Referring now to FIG. 2, a personnel work platform (PWP) control system shut-off switch module 60 is adapted for mounting to an upper cross-member 63 of the fork assembly. A cable 61 extends from the PWP control system shut-off switch module 60 and includes a connector 62 at its end, which is engageable with a connector of the forklift. In this manner, the PWP control system shut-off switch module 60 is selectively interconnected in the electrical system of the extendible boom forklift 10.

A releasable engagement arrangement is interposed between PWP control system shut-off switch module 60 and cross-member 63 of the fork assembly. Representatively, the releasable engagement arrangement may be in the form of mating hook-and-loop strips or the like secured to the underside of the module 60 and to the upwardly facing surface of cross-member 63. Any other type of releasable engagement arrangement may be utilized, such as a snap-type engagement fitting, a slide-on fitting with a detent arrangement, or any other construction which provides removable mounting of PWP control system shut-off switch module 60 to fork assembly 43. Further, while PWP control system shutoff switch module 60 is illustrated in FIG. 2 as mounted to cross-member 63 of fork assembly 43, it is understood that shut-off switch module 60 may be mounted in any other satisfactory location at the forward end of boom 14 so as to be in a location accessible by personnel supported on floor 54 of personnel work platform 42. For example, FIG. 1 illustrates the switch module 60 mounted to an upper rail 65 of the personnel work platform 42.

As illustrated in FIG. 2, PWP control system shut-off switch module 60 includes a housing 64 and a shut-off switch 66. Housing 64 includes an upper wall to which a decal is secured, for providing a visual indication as to the function of the shut-off switch 66. Shut-off switch 66 is movable between a raised position and a depressed position. In a manner to be explained, shut-off switch 66 is interconnected in the electrical system of vehicle 10 such that, when shut-off switch 66 is in its raised position, the boom control system is operable to enable an operator to manipulate the boom controls to alter the position of boom 14 and thereby personnel work platform 42. When shut-off switch 66 is depressed, the control of boom 14 is disabled so as to prevent operation of boom 14.

Figure 3:
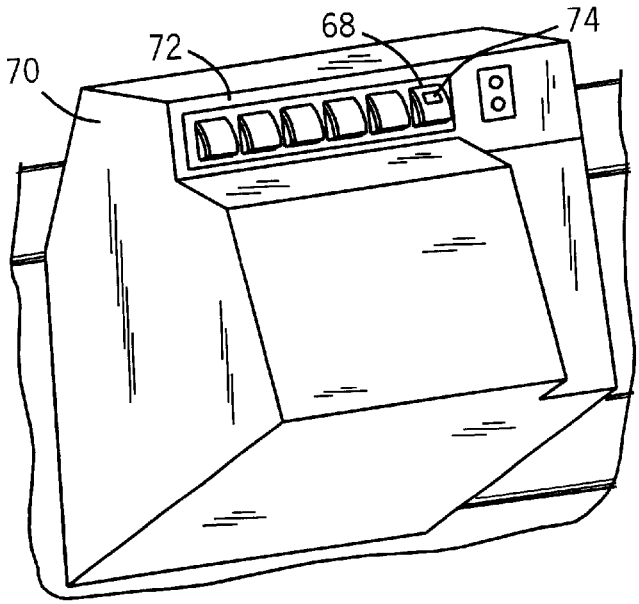
FIG. 3 is a partial perspective view illustrating the control panel used to operate the boom-type vehicle and engage the modified PWP control system of the present invention.

FIG. 3 illustrates a PWP control system actuator switch 68 mounted in the vehicle dashboard 70, which is located within cab 22 of extendible boom forklift 10. Actuator switch 68 is located in a switch panel 72 mounted within dashboard 70 adjacent to the steering wheel and other manually operated components of extendible boom forklift 10. Actuator switch 68 is movable between an ON position and an OFF position, and includes an indicator light 74 for indicating when switch 68 is in the ON position. Actuator switch 68 functions to provide modified operation of the control system of extendible boom forklift 10 when personnel work platform 42 is carried by fork assembly 43 and shut-off switch 66 is in its ON position. When PWP system actuator switch 68 is in its OFF position, extendible boom forklift 10 is operable in its usual manner so as to provide extension, retraction, raising and lowering of boom 14, as well as tilting movement of nose section 36.

Figure 4:
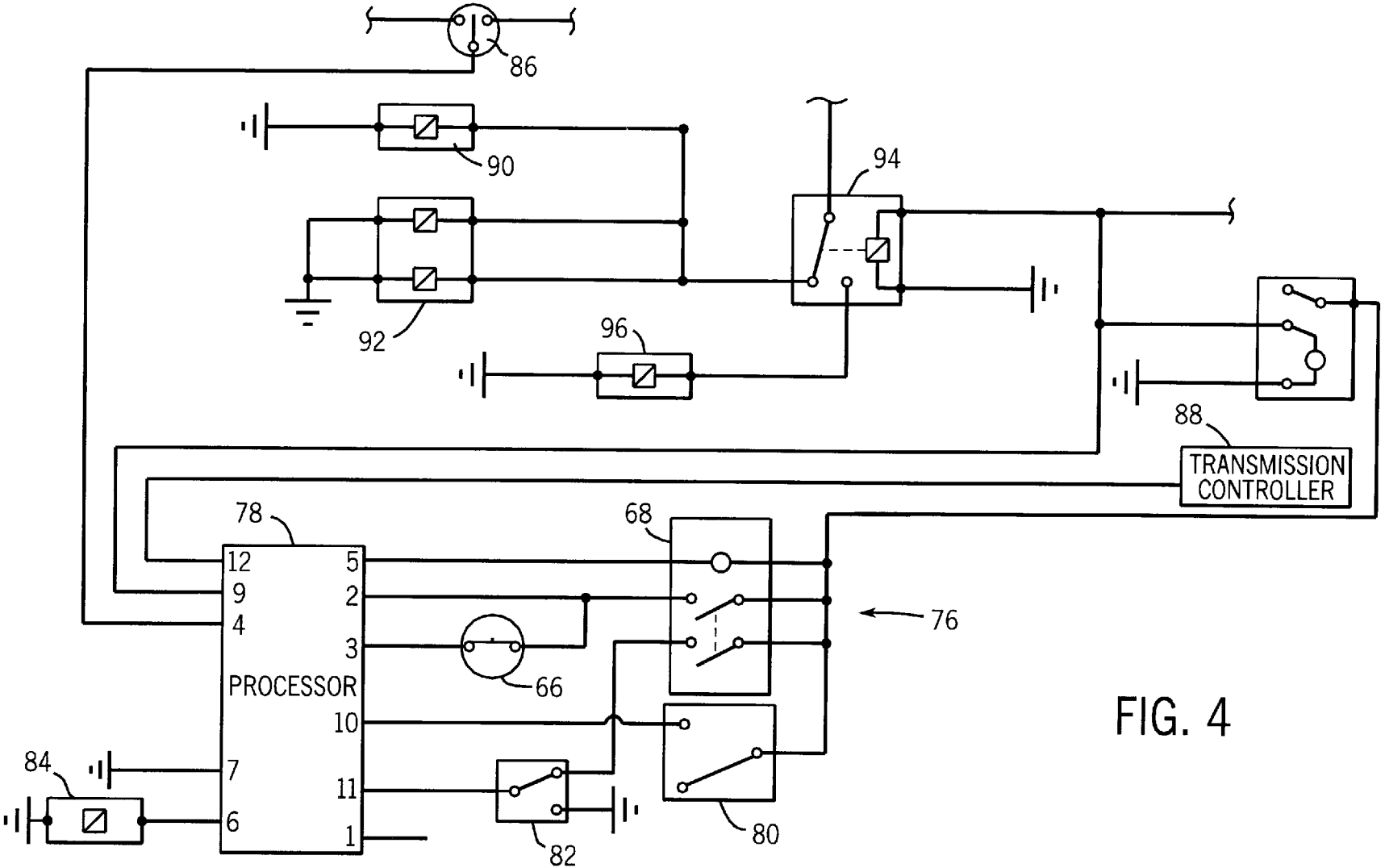
FIG. 4 is a schematic illustration of the PWP control system of the present invention.

Referring now to FIG. 4, thereshown is the PWP control system 76 of the present invention. The PWP control system 76 is interconnected in the electrical system of the extendible boom forklift 10 for altering normal operation of the extendible boom forklift 10. The PWP control system 76 is centered around a microprocessor 78 that has multiple inputs and multiple outputs for affecting the operation of the extendible boom forklift 10. The microprocessor 78 receives inputs from the PWP system actuator switch 68 and the shut-off switch 66. Further, a brake pressure switch 80 and a level sensor/switch 82 provide additional inputs to the microprocessor 78.

On the output side, microprocessor 78 is interconnected with a joystick disengage solenoid 84, a joystick switch 86 and the transmission controller 88. Further, an output pin of the microprocessor 78 is connected to a parking brake solenoid 90 and a pair of stabilizing cylinder solenoids 92 through a solenoid switch 94 including an internal relay. The solenoid switch 94 is further connected to a frame leveling speed solenoid 96, which will be discussed in detail below.

With reference to the electrical schematic of FIG. 4, the operation of the PWP control system 76 to modify the operation of the extendible boom forklift 10 will now be described. Initially, the operator operates the forklift 10 to engage the personnel work platform 42 on the pair of forks 59. Once the personnel work platform 42 is supported, the shut-off switch module 60 is interconnected to the electrical system of the forklift 10 through its connector. As illustrated in FIG. 2, the shut-off switch module 60 is mounted to the cross-member 63 of the fork assembly 43 such that the shut-off switch module 60 is accessible by a person on the personnel work platform 42.

In order to begin operating the forklift in its PWP mode, the PWP system actuator switch 68 is moved to its ON position. Upon initially moving the PWP system actuator switch 68 to its ON position, the indicator light 74 on the PWP system actuator switch 68 will begin flashing. A flashing indicator light 74 indicates that the forklift is not yet operating in the PWP mode.

In order to enter the PWP mode, the operator of the forklift must apply the service brakes for five seconds while holding the PWP system actuator switch 68 in its ON position. The brake pressure switch 80 senses the application of the service brakes and provides this signal to the microprocessor 78. After five seconds of continuous application, the indicator light 74 will remain on, indicating that the forklift is in the PWP mode.

Upon entering the PWP mode, the microprocessor checks the signal from the level sensor/switch 82. The level sensor/switch 82 is contained within the cab of forklift 10 and ascertains the side-to-side angle of forklift 10 and provides an input to the microprocessor 78. If the forklift 10 is outside of a predetermined acceptable range, e.g. two degrees from side to side, the microprocessor disables the boom control through the joystick disengage solenoid 84 so that the boom cannot be extended, retracted, raised or lowered.

When the forklift 10 has been satisfactorily leveled using the leveling cylinders, in a manner as is known, the microprocessor 78 of the PWP control system 76 senses the satisfactory position of the forklift through the level sensor/switch 82 and enables operation of the boom control.

Once the microprocessor 78 begins operation in the PWP mode, the microprocessor 78 delivers a signal to the transmission controller 88 that causes the transmission controller 88 to disengage the clutch of the forklift 10. Disengagement of the clutch prevents the forklift from moving while the forklift is in the PWP mode. At this time, it is important to note that the transmission controller 88 simply declutches the transmission, rather than shifting the forklift into neutral.

In addition to declutching the transmission, the microprocessor 78 transmits a signal to the solenoid switch 94, which closes a relay and applies the parking brake through the parking brake solenoid 90. With the parking brake activated and the transmission declutched, the extendible forklift 10 cannot be moved. In addition to activating the parking brake, the solenoid switch 94 locks the stabilizing system of the extendible boom forklift 10 through a pair of stabilizing cylinder solenoids 92, so as to provide a secure four-point stance, in a manner as is known.

When the forklift 10 enters the PWP mode, the microprocessor 78 deactivates the tilt function of the nose section 36 and deactivates the auxiliary hydraulics that are present in the forklift 10. In this manner, the PWP control system 76 provides further safety features for the workers on the personnel work platform 42.

Figure 5:
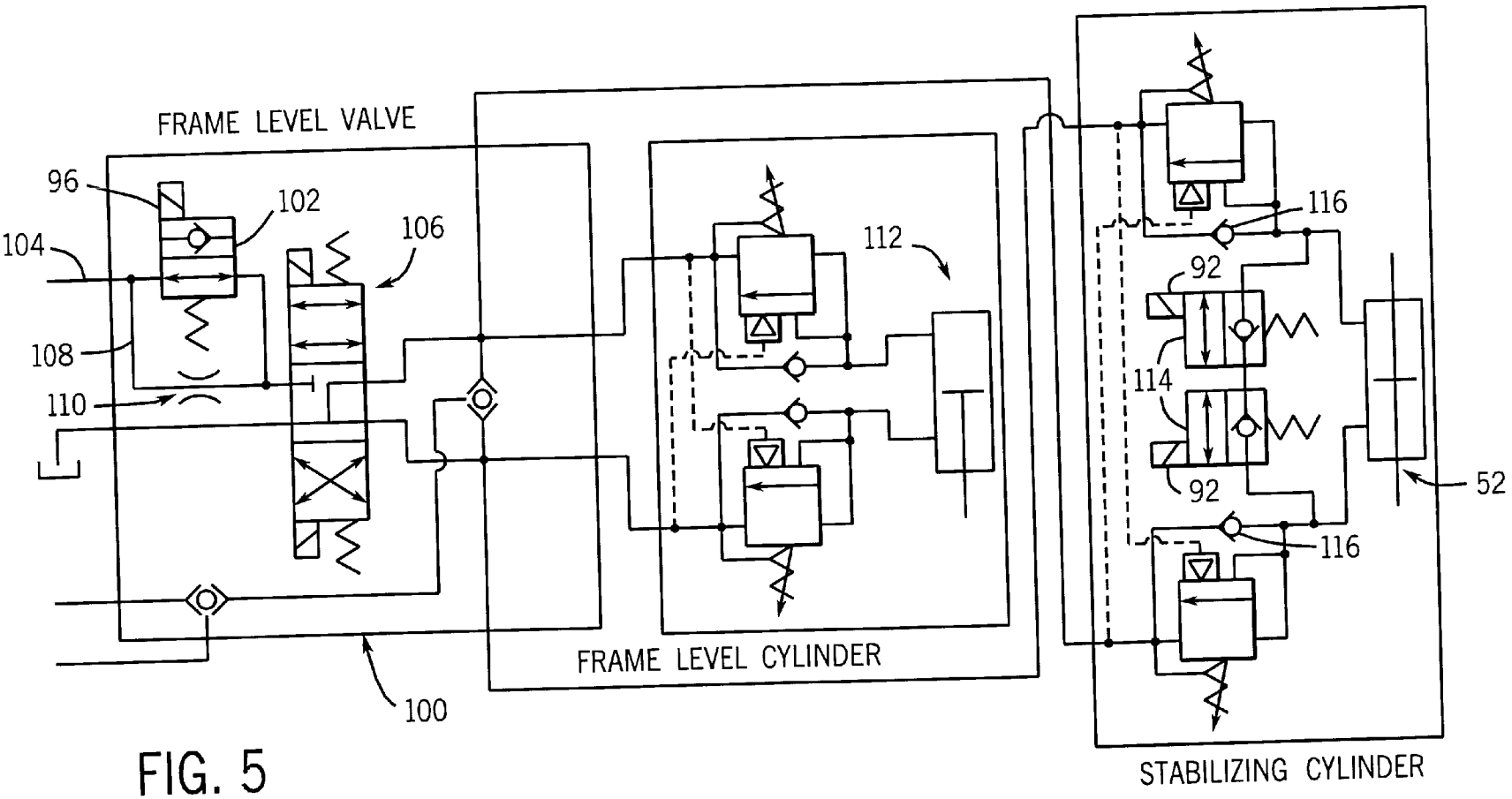
FIG. 5 is a schematic diagram of the hydraulic circuit illustrating the speed control mechanism used to limit the frame leveling speed in accordance with the present invention, incorporated into the extendible boom vehicle of FIG. 1.

In addition to controlling the operation of the various operation components of the extendible boom forklift 10, the PWP control system 76 restricts the flow of hydraulic fluid to the frame leveling cylinder of the forklift 10 to retard the speed of operation of the leveling cylinder. Referring now to FIG. 5, thereshown is a portion of the hydraulic circuit of the forklift 10 containing the frame leveling speed control solenoid 96 and stabilizing cylinder solenoids 92.

The frame leveling speed control solenoid 96 is interconnected in a frame leveling valve, shown schematically at 100, and controls the position of a frame leveling speed control valve 102. The frame leveling speed control valve 102 is connected in a line 104, which in turn is connected to a three-position four-way frame leveling control valve 106 through a line 108. A flow restrictor 110 is positioned in the branch line 108.

Frame leveling speed control valve 102 is spring biased toward a normal flow position, as shown in FIG. 5. Upon actuation of the frame leveling speed control solenoid 96 by the microprocessor 78, the frame leveling speed control valve 102 is forced to a checked position in which the flow of fluid in line 104 is cut off and fluid is supplied to the frame leveling valve 106 through line 108 and flow restrictor 110. When this occurs, a reduced flow of fluid is supplied to the frame leveling cylinder, shown in FIG. 5 at 112, thereby slowing the speed of frame leveling of forklift 10 when the forklift 10 is operating in the PWP mode. In the embodiment of the invention illustrated in FIG. 5, the flow restrictor 110 may provide up to a ninety-percent reduction in the fluid flow rate to the frame leveling cylinder 112.

As noted previously, power to the stabilizing cylinder solenoids 92 is cut off when the forklift 10 is operating in the PWP mode. When this occurs, a pair of stabilizing cylinder control valves 114 are spring biased from a flow position, which provides normal operation of the stabilizing cylinder 52, to a checked position, shown in FIG. 5, which combines with check valves 116 to prevent fluid from flowing into or out of the stabilizing cylinder 52. This functions to lock the stabilizing cylinder 52 in position to prevent movement of the stabilizing cylinder 52 when the frame leveling cylinder 112 is being operated in response to the frame leveling control valve 106. With this system, operation in the PWP mode provides for slow frame leveling to prevent injury to workers on the platform. In addition, the stabilizing cylinder 52 is locked to prevent the rocking movement of the forklift 10.

In operation, the PWP control system 76 of FIG. 4 ensures that a predetermined set of safety parameters are satisfied before the forklift 10 can be operated to alter the position of the work platform assembly 42. Once the safety conditions are satisfied, the boom can be raised, lowered, extended and retracted so as to place personnel supported by the work platform assembly 42 in a desired elevated position. If at any time one of the occupants of the work platform assembly 42 desires to stop movement of the work platform assembly 42 by stopping movement of the boom, shut-off switch 66 is depressed and moved to its OFF position so as to immediately operate the joystick disengage solenoid 84 and disable the joystick switch 86 to prevent operator control of the boom. When it is desired to restore such operation of the boom, shut-off switch 66 is returned to its ON position so as to once again enable operation of the boom to adjust the position of the work platform assembly 42.

Once the operator of the forklift 10 determines that he no longer desires to operate in the PWP mode, the PWP system actuator switch 68 is moved to the OFF position. Once the PWP system actuator switch 68 is moved to the OFF position, the indicator light 74 begins to flash. At this time, the PWP control system 76 will not leave the PWP mode until the service brakes have been applied for five seconds. The microprocessor 78 senses the application of the service brakes through the brake pressure switch 80, as shown in FIG. 4. The microprocessor 78 requires application of the service brakes, since upon exiting the PWP mode, the microprocessor generates a signal to the transmission controller 88 that re-engages the clutch. Since the transmission controller 88 did not shift the transmission to neutral, but instead declutched the transmission, the transmission will return to the gear it was in prior to engagement of the PWP system. Therefore, the operator is required to have his or her foot on the brake when the PWP mode is disengaged.

In operation, the PWP control system 76 ensures that a predetermined set of operational safety parameters are satisfied before the forklift can be operated to alter the position of the work platform assembly 42. Once the safety conditions are satisfied, the boom can be raised, lowered, extended and retracted so as to place personnel supported by the work platform assembly 42 in a desired elevated position. If at any time one of the occupants of work platform assembly 42 desires to stop movement of work platform assembly 42 by stopping movement of the boom, shut-off switch 66 is depressed and moved to its OFF position so as to immediately operate the joystick disengage solenoid 84 and to thereby disable the operator control of the boom. When it is desired to restore such operation of the boom, shut-off switch 66 is returned to its ON position so as to once again enable operation of the boom 14 to adjust the position of work platform assembly 42.

It can thus be appreciated that the present invention provides a relatively simple and efficient system for controlling operation of a reach-type vehicle to which a personnel work platform is mounted. The system involves an adaptation to existing electrical and hydraulic systems, which operate the components of the reach-type vehicle. The invention ensures that predetermined conditions are met before the vehicle can be operated with the PWP control system actuated, and provides modified operation.

Various alternatives and embodiments are contemplated as being within the scope of the following claims particularly pointing out and distinctly claiming the subject matter regarded as the invention.

We claim:

1. A personnel work platform (PWP) control system for use with a boom-type vehicle to which a personnel work platform is selectively mounted, wherein the boom-type vehicle includes a vehicle control system and a set of operating components, including a frame leveling arrangement for leveling the boom-type vehicle relative to the ground and an extendible boom, that operate in a first mode during normal operation, the PWP control system comprising:

a controller interconnected with the vehicle control system of the boom-type vehicle and the set of operating components;

a PWP system actuator switch interconnected with the controller, wherein actvation of the PWP system actuator activates the controller such that the controller interacts with the operating components to operate the operating components in a second, PWP mode of operation; and a shut-off switch located adjacent to the personnel work platform and interconnected to the controller, wherein when the operating components are operating in the second, PWP mode of operation, the activation of the shut-off switch prevents further operation of the extendible boom.

2. The PWP control system of claim 1, wherein the shut-off switch is remotely engageable with the controller.

3. The PWP control system of claim 2, wherein the controller operates the operating components in the second, PWP mode only upon detection of the connection of the shut-off switch to the controller.

4. The PWP control system of claim 1, wherein the controller is interconnected with a brake pressure switch positioned to detect the application of the service brakes of the boom-type vehicle, wherein the controller operates the operating components in the second, PWP mode only upon detection of the simultaneous application of the service brakes and the PWP system actuator switch.

5. The PWP control system of claim 4, wherein the controller operates the operating components in the second PWP mode only upon the simultaneous application of the service brakes and the PWP system actuator switch for a continuous predetermined period of time.

6. The PWP control system of claim 1, wherein the controller is interconnected with a level sensor/switch positioned to detect the orientation of the boom-type vehicle relative to horizontal, wherein the controller operates the operating components in the second, PWP mode only when the orientation of the vehicle is within a predetermined range of operation.

7. The PWP control system of claim 6, wherein the level sensor/switch is positioned in a cab of the vehicle.

8. The PWP control system of claim 1, wherein the frame leveling arrangement including a leveling speed solenoid interconnected with the controller, wherein the leveling speed solenoid enables the frame leveling arrangement to operate at a first speed of operation when the vehicle control system is in the first mode of operation and to operate at a second speed of operation, which is less than the first speed in the second, PWP mode of operation.

9. The PWP control system of claim 1, wherein the controller comprises a microprocessor, and wherein the set of operating components are operable in response to the vehicle control system, wherein the microprocessor interfaces with the vehicle control system to provide operation of the operating components in the second mode of operation.

10. A method of operating a boom-type vehicle having a frame, a set of ground-engaging wheels and tires mounted to the frame, a frame leveling arrangement interposed between the frame and the wheels, service brakes interconnected with the wheels, a boom pivotally mounted to the frame, and a vehicle control system for controlling the operation of the boom-type vehicle in a first mode during normal operations the method comprising the steps of:

enabling operation of the frame leveling arrangement at a first speed in the first mode of operation;

selectively engaging a personnel work platform (PWP) with the boom-type vehicle;

actuating a PWP system actuator switch interconnected in the vehicle control system;

operating the boom-type vehicle in a second PWP mode of operation with the personnel work platform attached and the PWP system actuator switch actuated;

automatically engaging a parking brake of the vehicle and enabling operation of the frame leveling arrangement at a second speed, which is less than the first speed, when the boom-type vehicle is in the second, PWP mode of operation;

disengaging a clutch of the vehicle to prevent movement of the vehicle when the vehicle is operated in the second, PWP mode of operation; and interconnecting a shut-off switch in the vehicle control system, wherein when the vehicle is in the second, PWP mode of operation, the shut-off switch is operable to selectively stop movement of the boom of the vehicle in response to manual actuation by a person on the personnel work platform.

11. The method of claim 10 further comprising the step of monitoring for the application of the service brakes of the vehicle and operating the boom-type vehicle in the second PWP mode of operation only upon the simultaneous application of the service brakes and the PWP system actuator switch.

12. The method of claim 10 further comprising the steps of:

sensing the orientation of the vehicle relative to horizontal; and preventing operation of the vehicle in the second, PWP mode when the orientation of the vehicle is outside of a predetermined acceptable range.

13. The method of claim 10 further comprising the step of preventing operation of the boom upon actuation of the shut-off switch by actuation of a joystick disengage solenoid.

14. A method of operating a boom-type vehicle having a frame, a set of ground-engaging wheels and tires mounted to the frame, a set of operating components including a frame leveling arrangement interposed between the frame and the wheels, service brakes interconnected with the wheels, and a boom pivotally mounted to the frame, the vehicle having a vehicle control system that operates the set of operating components in a first mode during normal operation, the method comprising the steps of:

selectively engaging a personnel work platform (PWP) with the boom-type vehicle;

interconnecting a PWP control system with the vehicle control system of the boom-type vehicle, the PWP control system including a controller being interconnected with the set of operating components of the boom-type vehicle such that the controller can operate the operating components of the boom-type vehicle in a second, PWP mode of operation;

interconnecting a shut-off switch to the controller of the PWP control system, wherein the controller prevents operation of the boom upon manual activation of the shut-off switch by a person on the personnel work platform;

connecting a PWP system actuator switch to the controller of the PWP control system, the PWP system actuator switch being selectively actuated to initiate operation of the vehicle in the second, PWP mode; and operating the operating components of the boom-type vehicle in the second, PWP mode of operation with the personnel work platform changed and the PWP system actuator switch actuated, wherein the controller of the PWP control system automatically engages a parking brake of the vehicle and disengages a clutch of a vehicle to prevent movement of the vehicle when the controller begins operation of the boom-type vehicle in the second, PWP mode of operation.

15. The method of claim 14 further comprising the steps of:

enabling operation of the frame leveling arrangement at a first speed in the first mode of operation; and enabling operation of the frame leveling arrangement at a second speed, which is less than the first speed, when the boom-type vehicle is in the second, PWP mode of operation.

16. The method of claim 15 further comprising the steps of:

sensing the orientation of the vehicle relative to horizontal; and preventing operation of the vehicle in the second, PWP mode when the orientation of the vehicle is outside of a predetermined acceptable range.

17. The method of claim 14 further comprising the steps of:

monitoring for the actuation of the service brakes of the vehicle; and operating the boom-type vehicle in the second mode of operation only upon simultaneous actuation of the service brakes and the PWP system actuator switch.

18. The method of claim 17 further comprising the step of monitoring for the simultaneous actuation of the service brakes and the PWP system actuator switch, wherein the controller operates the vehicle in the second, PWP mode only when the service brakes and PWP system actuator switch are simultaneously actuated for more than a predetermined period of time.

19. A boom-type vehicle for use in supporting a personnel work platform, the vehicle comprising:

a frame;

a set of ground-engaging wheels and tires interconnected with the frame;

a frame leveling arrangement interposed between the frame and the wheels for leveling the frame relative to horizontal;

service brakes interconnected with the wheels;

an extendible boom pivotally mounted to the frame, the boom configured to support the personnel work platform and position the personnel work platform relative to the frame;

a personnel work platform control system including a controller interconnected with a set of operating components of the boom-type vehicle that includes the frame leveling arrangement, a parking brake and the extendible boom, wherein the vehicle is normally operated in a first mode of operation and the controller can operate the boom-type vehicle in a second, PWP mode of operation;

a PWP system actuator switch interconnected with the controller, wherein actuation of the PWP system actuator switch activates the controller such that the controller operates the operating components of the vehicle in the second, PWP mode of operation during which the speed of operation of the frame leveling arrangement is decreased and the parking brake is applied; and a shut-off switch located adjacent to the personnel work platform and interconnected to the controller, wherein actuation of the shut-off switch when the operating components are in the second, PWP mode of operation prevents operation of the extendible boom of the vehicle.

20. The boom-type vehicle of claim 19 wherein the controller is interconnected with a brake pressure switch positioned to detect the actuation of the service brakes of the boom-type vehicle, wherein the controller operates the operating components in the second, PWP mode only upon detection of the simultaneous actuation of the service brakes and the PWP system actuator switch.

21. The boom-type vehicle of claim 20 wherein the controller operates the operating components in the second, PWP mode only upon the simultaneous actuation of the service brakes and the PWP system actuator switch for a continuous predetermined period of time.

22. The boom-type vehicle of claim 19 further comprising a level sensor/switch positioned to detect the orientation of the boom-type vehicle relative to horizontal, wherein the controller operates the operating components in the second, PWP mode only when the orientation of the vehicle is within a predetermined range of operation.

23. The boom-type vehicle of claim 22 wherein the level sensor/switch is positioned in the cab of the vehicle.

24. The boom-type vehicle of claim 19 wherein the frame leveling arrangement includes a leveling speed solenoid interconnected with the controller, wherein the leveling speed solenoid enables the frame leveling arrangement to operate at a first speed of operation when the vehicle control system is in the first mode of operation, and enables the frame leveling arrangement to operate at a second speed of operation, which is less than the first speed, in the second, PWP mode of operation.

* * * * *

UNITED STATES PATENT AND TRADEMARK OFFICE

CERTIFICATE OF CORRECTION

PATENT NO. : 6,595,330 B1
DATED : July 20, 2003
INVENTOR(S) : Lance B. Henrickson et al.

It is certified that error appears in the above-identified patent and that said Letters Patent is hereby corrected as shown below:

Column 9,
Line 9, delete “actvation” and substitute therefor -- activation --.

Column 11,
Line 5, delete “changed” and substitute therefor -- engaged --.

Signed and Sealed this

Twenty-first Day of October, 2003

JAMES E. ROGAN
*Director of the United States Patent and Trademark Office*